US008242781B2

(12) United States Patent
Benischek et al.

(10) Patent No.: US 8,242,781 B2
(45) **Date of Patent: *Aug. 14, 2012**

(54) SYSTEM AND METHOD FOR DETERMINING SUB SURFACE GEOLOGICAL FEATURES AT AN EXISTING OIL WELL SITE

(75) Inventors: Vincent Benischek, Shrub Oak, NY (US); Michael Currie, New Hyde Park, NY (US); Rajneeta Basantkumar, Mineola, NY (US); Gennady Lyasko, Freehold, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 434 days.

This patent is subject to a terminal disclaimer.

(21) Appl. No.: 12/545,068

(22) Filed: Aug. 20, 2009

(65) Prior Publication Data

US 2010/0073001 A1 Mar. 25, 2010

Related U.S. Application Data

(60) Provisional application No. 61/090,529, filed on Aug. 20, 2008, provisional application No. 61/090,533, filed on Aug. 20, 2008, provisional application No. 61/090,536, filed on Aug. 20, 2008, provisional application No. 61/090,542, filed on Aug. 20, 2008.

(51) Int. Cl.
*G01V 3/00* (2006.01)

(52) U.S. Cl. ..... 324/334

(58) Field of Classification Search ..... None
See application file for complete search history.

(56) References Cited

U.S. PATENT DOCUMENTS

| | | | |
|---|---|---|---|
| 2,015,401 | A | 9/1935 | Jakosky |
| 3,085,197 | A | 4/1963 | Hings |
| 3,943,436 | A | 3/1976 | Pirson et al. |
| 4,140,179 | A | 2/1979 | Kasevich et al. |
| 4,298,967 | A | 11/1981 | Hawkins |
| 4,620,593 | A | 11/1986 | Haagensen |
| 4,627,036 | A | 12/1986 | Wyatt |
| 4,641,099 | A | 2/1987 | Lee et al. |
| 4,705,108 | A | 11/1987 | Little et al. |

(Continued)

FOREIGN PATENT DOCUMENTS

WO 00/57021 A1 9/2000

OTHER PUBLICATIONS

R. Tao and X. Xu, Reducing the Viscosity of Crude Oil by Pulsed Electric or Magnetic Field, Feb. 17, 2006, Energy and Fuels, 2006, pp. 2046-2051.

*Primary Examiner* — Jermele M Hollington
(74) *Attorney, Agent, or Firm* — Howard IP Law Group, P.C.

(57) ABSTRACT

An array of electromagnetic receiver antennae is arranged and operated in conjunction with the operation of an array of far field electromagnetic transmitter antennae for mapping subsurface features of an existing well site reservoir. Mapping is performed according to the relative intensities, frequencies, phase shifts, and/or other reflected signal parameters of the reflections received by the receiver antennae (relative to the transmit signals) associated with a given location or target area within a reservoir so as to aid in determining the geological features about an oil deposit for an existing oil well.

11 Claims, 11 Drawing Sheets

U.S. PATENT DOCUMENTS 5,065,819 A 11/1991 Kasevich
5,109,927 A 5/1992 Supernaw et al.
5,152,341 A 10/1992 Kasevich et al.
5,236,039 A 8/1993 Edelstein et al.
5,495,259 A 2/1996 Lyasko
6,651,739 B2 11/2003 Arndt et al.
7,091,460 B2 8/2006 Kinzer
7,191,063 B2 3/2007 Tompkins
7,244,694 B2 7/2007 Fu et al.
7,400,976 B2 7/2008 Young et al.
7,519,474 B2 4/2009 Zhou et al.
7,980,327 B2 * 7/2011 Benischek et al. ..... 324/331
8,055,447 B2 * 11/2011 Benischek et al. ..... 702/6
2004/0239330 A1 12/2004 Weaver et al.
2005/0199386 A1 9/2005 Kinzer
2006/0283598 A1 12/2006 Kasevich
2007/0137858 A1 6/2007 Considine et al.
2008/0135237 A1 6/2008 Dubost et al.
2008/0236270 A1 * 10/2008 Denichou et al. ..... 324/347
2008/0288173 A1 11/2008 Saenger
2009/0321132 A1 12/2009 Ouellet et al.
2010/0071894 A1 * 3/2010 Benischek et al. ..... 166/248
2010/0071955 A1 * 3/2010 Benischek et al. ..... 702/7
2010/0082254 A1 * 4/2010 Benischek et al. ..... 324/334
2010/0102986 A1 * 4/2010 Benischek et al. ..... 340/855.8
2010/0198638 A1 8/2010 Deffenbaugh et al.

* cited by examiner

SYSTEM AND METHOD FOR DETERMINING SUB SURFACE GEOLOGICAL FEATURES AT AN EXISTING OIL WELL SITE

CROSS-REFERENCE TO RELATED APPLICATIONS

This application claims priority to Provisional Patent Application Ser. No. 61/090,529 entitled "Electromagnetic Based System and Method For Enhancing Subsurface Recovery of Fluid Within a Permeable Formation" filed Aug. 20, 2008, Provisional Patent Application Ser. No. 61/090,533 entitled "System and Method to Measure and Track Movement of a Fluid in an Oil Well and/or Water Reservoir Using RF Transmission" filed Aug. 20, 2008, Provisional Patent Application No. Ser. No. 61/090,536 entitled "Sub Surface RF Imaging Using An Antenna Array for Determining Optimal Oil Drilling Site" filed Aug. 20, 2008 and Provisional Patent Application Ser. No. 61/090,542 entitled "RF System and Method for Determining Sub-Surface Geological Features at an Existing Oil Web Site" filed Aug. 20, 2008, the subject matter thereof incorporated by reference in its entirety.

FIELD OF THE INVENTION

This invention relates generally to subsurface fluid recovery systems, and more particularly, to a system and method for imaging within a geological strata using an array of immediate far field transmitter antennae and receiver antennae for determining sub-surface features to aid in recovering oil from an existing well site.

BACKGROUND OF THE INVENTION

In the oil production industry, an oil well is typically drilled hundreds or thousands of feet within various geological strata to reach a permeable formation containing an oil reservoir. Such permeable formations include any subsurface or subterranean media through which a fluid (e.g. oil or water) may flow, including but not limited to soils, sands, shales, porous rocks and faults and channels within non-porous rocks. Various techniques may be used to increase or concentrate the amount of fluid such as oil in the area of the reservoir, such area being commonly referred to as an enhanced pool.

Generally, during the initial stage of oil production, the forces of gravity and the naturally existing pressure in a reservoir cause a flow of oil to the production well. Thus, primary recovery refers to recovery of oil from a reservoir by means of the energy initially present in the reservoir at the time of discovery. Over a period of time, the natural pressure of a reservoir may decrease as oil is taken at the production well location. In general, as the pressure differential throughout the reservoir and at the production well location decreases, the flow of oil to the well also decreases. Eventually, the flow of oil to the well will decrease to a point where the amount of oil available from the well no longer justifies the costs of production, which includes the costs of removing and transporting the oil. Many factors may contribute to this diminishing flow, including the volume and pressure of the oil reservoir, the structure, permeability and ambient temperature of the formation. The viscosity of the oil, particularly the oil disposed away from the central portion of the production well, the composition of the crude oil, as well as other characteristics of the oil, play a significant role in decreased oil production.

As the amount of available oil decreases, it may be desirable to enhance oil recovery within an existing reservoir by external means, such as through injection of secondary energy sources such as steam or gas into the reservoir to enhance oil flow to the production well location. Such mechanisms tend to forcibly displace the oil in order to move the oil in the direction of the production well. Such methods may also heat the oil in order to increase the oil temperature and its mobility. Such methods, however, often require drilling additional bore holes into the reservoir, heating the secondary materials and flooding the materials into the reservoir, in addition to post processing requirements for removing and filtering the secondary materials from the recovered oil. All of these contribute to additional production costs. Moreover, existing techniques still do not adequately enable complete recovery of all of the oil within the reservoir. Thus, in many cases, oil recovery may be discontinued despite a substantial amount of oil remaining within the reservoir, because extraction of the remaining oil is too expensive or too difficult given the current recovery methods.

Alternative mechanisms for enhancing oil recovery are desired.

SUMMARY OF THE INVENTION

An array of electromagnetic receiver antennae is arranged and operated in conjunction with the operation of an array of EM immediate far field transmitter antennae for mapping subsurface features of a reservoir. Mapping is performed according to the relative intensities, frequencies, phase shifts, and/or other reflected signal parameters of the reflections received by the receiver antennae (relative to the transmit signals) associated with a given location or target area within a reservoir so as to aid in determining the geological features about an oil deposit for an existing oil well.

By tuning the transmitter/receiver antenna elements to detect particular features such as fracture corridors or rock interfaces, the transmitters/receivers provide information that permits one to determine the most efficient and/or effective method of extracting oil from the reservoir, including but not limited to placement of additional auxiliary wells, positioning of EM transmitters for pulsing select areas of the reservoir to increase mobility of the oil in select locations, and taking remedial action to recover additional oil in the well.

Different frequencies and/or transmit/receive power levels and durations may be used. For example, frequencies used to determine the content of the permeable formation (e.g. determining rock, clay, sand or gravel) will be different than those for imaging oil (or water). A digital control unit comprising a digital signal processor and antenna controller may be used to process the signals and frequencies according to the particular application.

Two dimensional (2D) mapping and imaging of the subsurface can be accomplished by rotating the sensor transmit/receiver assembly at various radii on the order of hundreds of meters, for example. Lookup tables of reflection/absorption values may be used to assist in the determination and estimation of the content and range of the geological features under test.

In one embodiment, a method for determining subsurface geological features at an existing oil well site having a well bore disposed through strata to a given subsurface layer depth for recovering crude oil in a fluid reservoir at the subsurface depth but horizontally remote from the well bore comprises:

a) from multiple positions on the terrain surface, transmitting immediately in the far field pulsed electromagnetic energy beam signals focused at a target depth that combine to cover a target area of a formation layer that lies between the terrain surface and the given subsurface layer containing the fluid reservoir defining a scan, the target area having a center offset horizontally from the well bore; b) receiving reflections from the target area in response to the transmitted pulsed energy beam signals impinging thereon, the reflections being characteristic of particular media located within the target area being impinged upon by the immediately transmitted far field pulsed electromagnetic energy beam signals; c) correlating the received reflections from the target area over a given time interval for a given scan to determine relative changes in intensities of reflections over the target area for a given scan; d) storing the scan data for each scan in memory; modifying transmit parameters in at least one of frequency, focus depth, and phase shift and repeating steps a)-d) to generate volume data for each layer up to the given subsurface layer; identifying particular media and their location within the volume according to the scan data, wherein the identifying includes identifying the location of crude oil relative to other of the particular media.

The method further comprises drilling an auxiliary well for insertion of a forced fluid into the auxiliary well. The determined path of the auxiliary well is adapted to avoid select ones of the particular media within the reservoir and encounter the crude oil media based on the identification. The step of identifying includes correlating the relative changes in intensities of reflections with data relating to characteristics of particular media stored in memory to identify select ones of the particular media within the volume. The particular media include at least one of rock and water. The crude oil particles have reflection characteristics different from that of rock and water.

There is further disclosed a system for determining subsurface geological features at an existing oil well site having a well bore disposed through strata to a given subsurface layer depth for recovering crude oil in a fluid reservoir at the subsurface depth but horizontally remote from the well bore, the method comprising: a) a plurality of transmit antennae located at multiple positions on the terrain surface, the antennae transmitting immediately in the far field pulsed electromagnetic energy beam signals focused at a target depth that combine to cover a target area of a formation layer that lies between the terrain surface and the given subsurface layer containing the fluid reservoir defining a scan, the target area having a center offset horizontally from the well bore; b) a plurality of receive antennae located at multiple positions on or below the terrain surface, the receive antennae receiving reflections from the target area in response to the transmitted pulsed energy beam signals impinging thereon, the reflections being characteristic of particular media located within the target area being impinged upon by the immediately transmitted far field pulsed electromagnetic energy beam signals; c) a processor adapted to correlate the received reflections from the target area over a given time interval for a given scan to determine relative changes in intensities of reflections over the target area for a given scan; d) memory for storing the scan data for each scan; e) a controller for modifying transmit parameters in at least one of frequency, focus depth, and phase shift for each of a plurality of selected target depths to thereby define a scanned volume for each layer up to the given subsurface layer. The processor identifies particular media and their location within the volume according to the scan data, including identifying the location of crude oil relative to others of the particular media. The processor is adapted to correlate the relative changes in intensities of reflections with data relating to characteristics of particular media stored in memory to identify select ones of the particular media within a given formation layer. The particular media include at least one of rock and water, and the crude oil has reflection characteristics different from that of rock and water.

An initial reflectance reference is established indicative of the intensities of reflected signals from the target volume over a predetermined interval, and the signal processor compares subsequent reflective intensities received in response to pulsed electromagnetic transmissions to the initial reflectance reference to determine relative movement of the particular media within the volume.

Each of the transmit antennae comprises a compact parametric antenna having a dielectric, magnetically-active, open circuit mass core, ampere windings around the mass core, the mass core being made of magnetically active material having a capacitive electric permittivity from about 2 to about 80, an initial permeability from about 5 to about 10,000 and a particle size from about 2 to about 100 micrometers; and an electromagnetic source for driving the windings to produce an electromagnetic wavefront.

BRIEF DESCRIPTION OF THE DRAWINGS

Understanding of the present invention will be facilitated by consideration of the following detailed description of the preferred embodiments of the present invention taken in conjunction with the accompanying drawings, in which like numerals refer to like parts and.

DETAILED DESCRIPTION OF THE PREFERRED EMBODIMENTS

The following description of the preferred embodiments is merely by way of example and is in no way intended to limit the invention, its applications, or uses.

Figure 1:
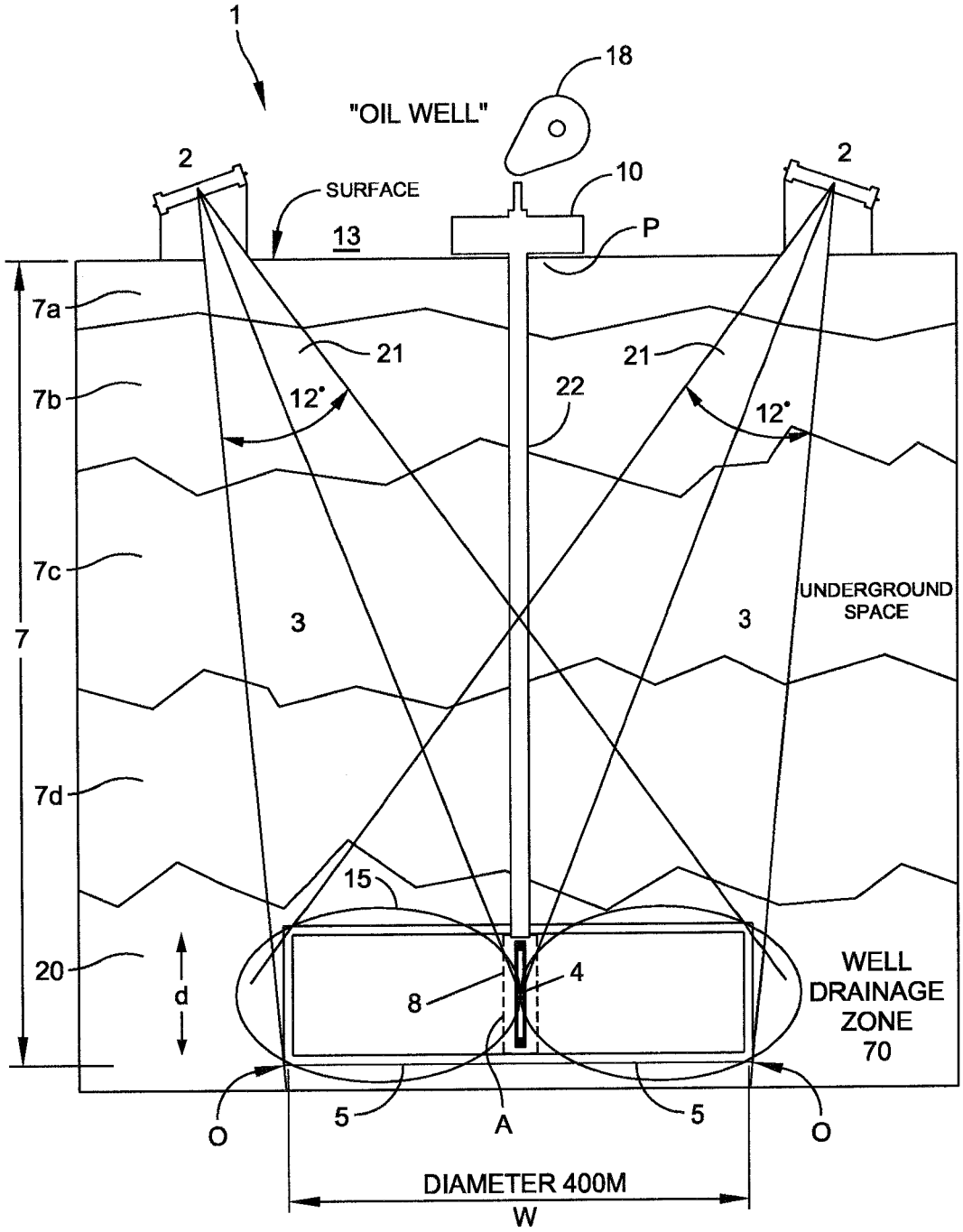
FIG. 1 is a schematic illustration of a system for imparting EM signals into a permeable reservoir formation containing oil to enhance oil flow, according to an exemplary embodiment.

Referring to FIG. 1, there is shown a schematic illustration of a system 1 for imparting EM signals into a permeable reservoir formation containing crude oil to enhance crude oil flow and recovery according to an embodiment of the present invention. As shown in FIG. 1, a production well 10 positioned on the terrain surface is drilled through geological strata indicated generally as 7 to form a borehole 22. As shown, the geological strata 7 may contain multiple layers (e.g. 7*a*, 7*b*, 7*c*, 7*d*) of material, such as soil, rock, shale, sand, water, underground space, and the like. Borehole 22 extends through the strata to a formation layer 20 defining a well drainage zone or reservoir 70 containing crude oil deposits (e.g. crude oil particles) for extraction. A filter casing 8 such as a perforated or mesh structure supporting the borehole is used in combination with a pump 18 to extract and recover the crude oil contained within the reservoir. It is understood that the layer containing the oil to be recovered is volumetric and extends three dimensionally in depth, width and length. Depth (d) is illustrated along the vertical axis and width (w) is illustrated along the horizontal axis as shown in the two dimensional representation depicted in FIG. 1.

A problem encountered as part of the oil production process is that often there exists a rather large horizontal spread of the oil deposit within the well drainage zone 70 as shown in FIG. 1. During initial drilling and oil production, the area A containing oil and located near (adjacent) the casing 8 within the reservoir is most easily extracted from the reservoir. However, at distances more remote from the central location A (e.g. locations nearer the outermost perimeters O of reservoir 70) the oil may have different viscosities. The viscosity of the oil at the more remote locations tends to be much greater than the viscosity of the oil at the central area as a function of the horizontal distance away from the central area A. The difference in viscosity (e.g. relative increase in viscosity) of the oil away from the central A of the reservoir contributes to the difficulties in harvesting such oil, and results in an undesirable amount of oil remaining in the reservoir.

According to an embodiment of the present invention, FIG. 1 shows a compact antenna system 1 comprising an array of antennae 2 positioned at a point (either below or on the ground surface) about the production well 10 at given locations along the terrain surface 13. The antennae are adapted for transmitting in the far field only, electromagnetic energy 15 focused to irradiate the well drainage zone 70 with an aggregate electromagnetic field producing an isotropic profile 5 within the reservoir 70. The aggregate electromagnetic field generated has a frequency and power sufficient to cause a decrease in the viscosity of the oil irradiated within the zone without increasing the temperature of the oil, thereby increasing oil mobility toward the central area of the reservoir. It is understood that electromagnetic energy heats a material only when the frequency of the energy can be absorbed by the molecular structure of the material, thereby "agitating" the structure such that the molecules move about more rapidly in random motion. In the present invention, the processing is performed such that the electromagnetic energy imparted via the EM antennae onto the oil particles or molecules causes the individual oil molecules to join together. Larger molecules in a suspended solution show a lower overall viscosity. According to an aspect of the present invention, the magnetic field component of the transmitted electromagnetic energy beam is sufficient to cause a reaction by the oil molecules to the magnetic portion of the field that reduces the viscosity of oil molecules.

Figure 2:
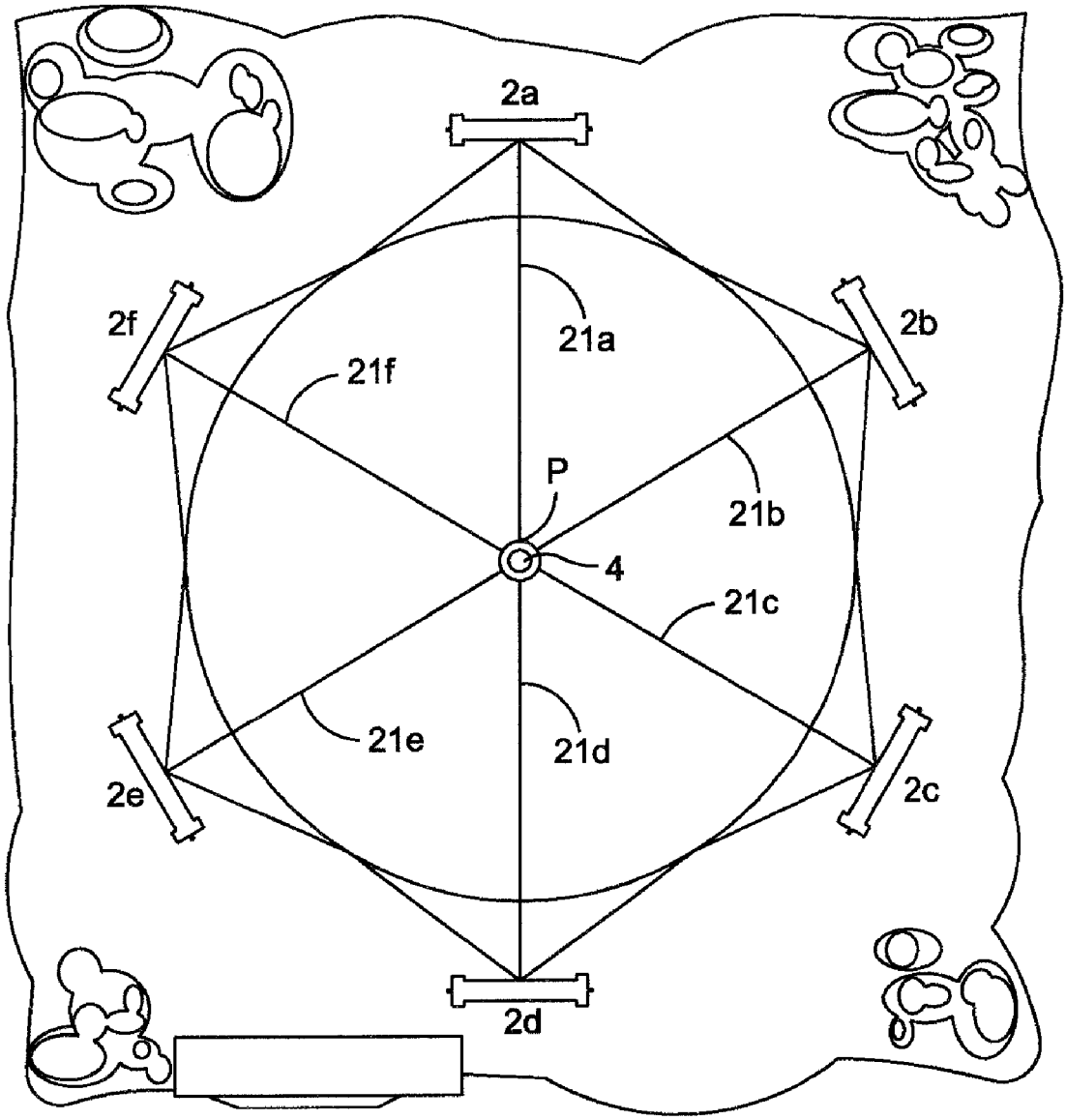
FIG. 2 is a schematic plan view showing the system configuration of FIG. 1 according to an exemplary embodiment.

Referring to FIG. 1 in conjunction with FIG. 2, in an exemplary embodiment, six EM antennae (2*a*, 2*b*, 2*c*, 2*d*, 2*e*, 2*f*) are positioned in uniform fashion about a central location or position P (corresponding for example, to the bore hole 10 location) and directed to transmit in the far field CW or pulsed electromagnetic beams 21*a*-21*f* through the strata to irradiate the well drainage zone 70 without near field losses and/or interference effects. Although 6 antennae are shown, it is understood that more (or less) antennae may be utilized depending on the particular application requirements. Preferably, 10 to 20 antennae may be configured in a given pattern to irradiate a target region at a depth of between 500 ft and 2000 ft. The antennae are configured so as to provide for each beam 21*a* directed radiation pattern having a conical profile 3 as shown in FIG. 1. By way of example only, the center of each transmit beam 21 is positioned to intersect at a location 4 within the central area A of the reservoir. The configuration and beam focusing associated with the array of antennae forms an isotropic radiation pattern or profile 5 that covers the drainage zone 70 to thereby increase oil movement in the zone by decreasing the viscosity of the oil due to the impinging EM energy. In a preferred embodiment, the outer 3 dB edge of the intersecting focused EM energy beams covers substantially the entire reservoir zone 70, as best shown in FIG. 1.

In order to enhance movement of the oil within the zone 70 multiple EM antennae are operated as shown in the configuration illustrated in FIG. 2. Compact parametric antennae (CPAs) may be positioned on or below the terrain surface whose beams are to be focused and impart a powerful magnetic field at a depth of the oil reserve to change the viscosity of the oil particles, making them more mobile and enhancing oil recovery from existing oil wells without adding any additional "oil drilling" hardware. The transmit antennae are positioned on (or below) the terrain surface and configured with respect to one another to transmit in the far field continuous wave (CW) or pulsed electromagnetic energy beams through the geological strata to generate an aggregate electromagnetic field having an isotropic profile focused onto the select subsurface region (e.g. the well drainage zone 70) containing the crude oil. The aggregate electromagnetic field impinges upon the crude oil particles at a frequency and energy sufficient to decrease the viscosity of oil particles to enhance crude oil flow within the select subsurface region. A controller 400 (see FIG. 4) provides control parameters for configuring the transmit antennae to transmit the far field electromagnetic beams. The control parameters include one or more of predetermined frequency, power, directivity orientation, and transmit duration parameters. The controller may also operate to steer the beams of the antennae to coalesce and focus within the target region at the desired frequency in order to accomplish the desired decrease in viscosity of the oil particles. Interference of the antenna patterns (constructive and/or destructive interference) may be utilized by the controller to control the output power in orientation and/or frequency at a target depth. The EM energy is focused and applied to the oil at a given frequency, power, and duration so as to decrease the oil viscosity without increasing the temperature of the oil. Controller 400 may be implemented as a digital signal controller (DSC) taking the form of a microcontroller, digital signal processor or other such device programmed to execute instructions for carrying out control functions, including timing functions, data storage and retrieval, and communications between the transmitters and various peripheral devices (e.g. sensors, receivers, monitoring devices, and the like). Controller 400 may be implemented in hardware, firmware, software or combinations thereof, as is understood by one of ordinary skill in the art.

Figure 3:
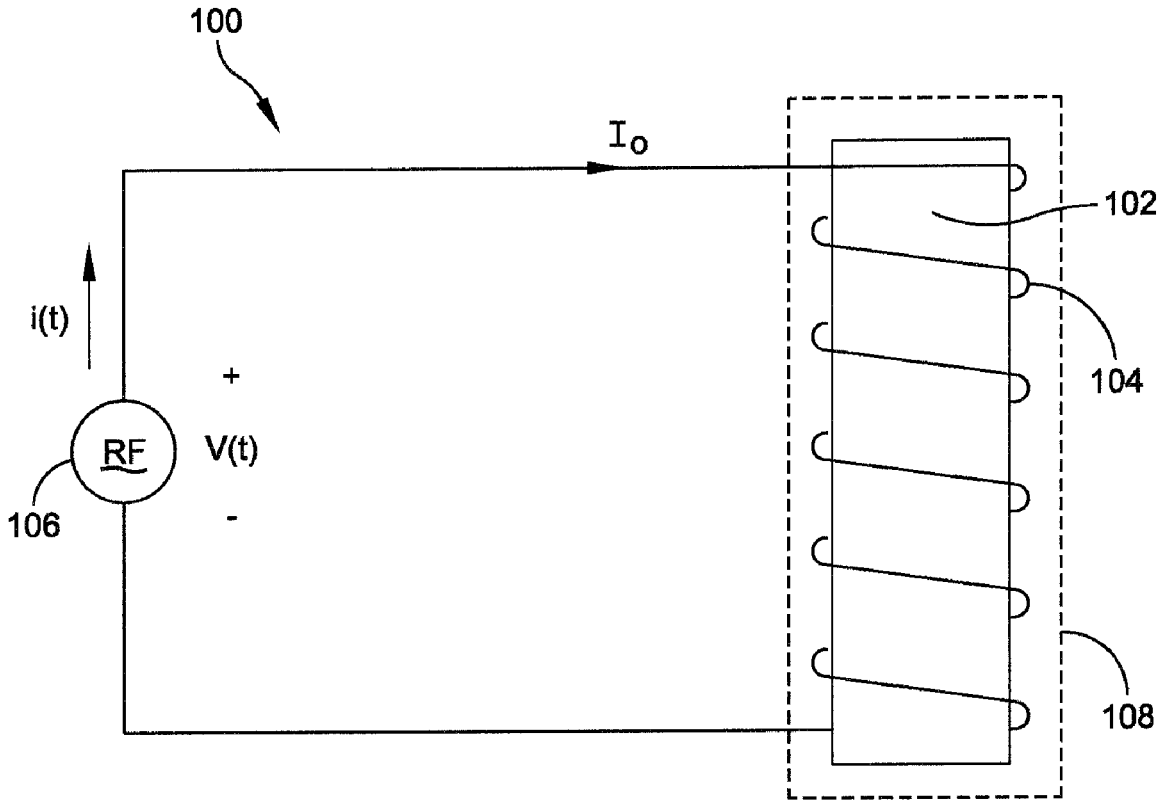
FIG. 3 is an exemplary antenna useful for implementing the present invention.

In a preferred embodiment, an antenna such as the one described in U.S. Pat. No. 5,495,259 entitled "Compact Parametric Antenna", the subject matter thereof incorporated by reference herein in its entirety, may be utilized to form the array of antennae depicted in FIG. 2. Such an exemplary antenna is shown in FIG. 3 and includes a dielectric, magnetically-active mass core 102, ampere windings 104 around mass core 102 and an EM source 106 for driving windings 104. Mass core 102 and windings 104 are preferably housed in an electromagnetic field permeable housing 108, for example, fabricated from fiberglass composite material. In accordance with Poynting vector theory S=E×H the EM current source 106 provides a sinusoidal current $I_0$ which drives the ampere windings 104 to stimulate an external electric field E. Through the induction of gyromagnetic, gyroscopic and Faraday effects in dielectric, magnetically-active, mass core 102, an external magnetic field H having an internal magnetic flux density B is provided, as further described in the aforementioned patent.

Each transmit antenna 2 (FIGS. 1-2) according to an embodiment of the present invention transmits with low loss (i.e. no near field loss) through the various strata including soil, water, rock and the like. That is, the CPA antenna design generates EM with no near field effect. The electromagnetic near field is fully formed within the antenna. The antenna is configured as a mobile antenna arranged in a compact housing that is many times smaller than the wavelength that it transmits (e.g. on the order of hundreds of times smaller). For example, at an antenna operating frequency of 3 kHz, the wavelength is 100,000 meters. Typical antenna systems are designed to be one half (i.e. ½) to one sixth (i.e. ⅙) the length of the wavelength. A CPA antenna operating at 3 kHz can be less than one meter (1 m) in length (or height) with an efficiency of greater than 50%. The antenna is also orientation independent to facilitate placement within various configurations. In one configuration, the antenna core is a mixture of active dielectric and magnetic material. The core material can have a combined magnetic permeability and electric permittivity>25,000. Core particle density (on the order of $10^{12}/cm^3$) are free flowing within the internal magnetic field. Active core material is coherently polarized and aligned with very high efficiency, resulting in very little core Joule heating. In a preferred embodiment, each individual antenna module adds about 6 dB of output Gain (such that an "n" module transmit antenna system adds $2^n$ Gain). For an antenna operating in the low kilohertz range (e.g. 5 kHz), the antenna housing may have a height of about 3 ft. The small size of the antenna package advantageously enables multiple antennae to be configured within a relatively small footprint.

In one non-limiting embodiment, the array of Compact Parametric Antennae is operated by applying electromagnetic energy for at least five minutes at a constant frequency (ranging from 100 Hz to greater than 10 kHz) consistent with good transmission and no near field loss through the intervening strata at an exemplary irradiated power of about 10 kilowatts (kW) to irradiate the oil at a depth defined by the well drainage zone 70. The energy beams propagating from transmit antennae are in the form of a CW or pulsed (i.e. high energy pulses of a given duration) transmission sequence, wherein the power, directivity, and/or frequency of the transmitted magnetic energy may be adjusted to provide a desired change (e.g. increase) in the rate of oil movement and hence oil recovery. In general, the system operates by providing the EM signal such that the aggregate magnetic field from the transmit antennae beams is focused at the depth of the oil reservoir so as to change the viscosity of the oil and make it more mobile, according to the following:

$$H_c = \frac{\lfloor k_B T/(n\mu_f)\rfloor(\mu_p + 2\mu_f)}{a^3(\mu_p - \mu_f)}$$

and $$\tau = \frac{n^{-1/3}}{v} = \frac{\pi\eta_o(\mu_p + 2\mu_f)^2}{\mu_f n^{5/3} a^5 (\mu_p - \mu_f)^2 H^2}$$

wherein $H_c$ represents the threshold magnetic field and where:

$k_B$—Boltzmann's constant

T—Absolute temperature $\mu_p$—Permeability of oil particles in the fluid reservoir $\mu_f$—Permeability of fluid a—radius of oil particle sphere τ—time to aggregate (by way of example, less than 1 minute)

n—Particle number density

H—magnetic field on the particle v—Average velocity $\eta_o$—Viscosity

In an exemplary embodiment, the magnetic field transmitted in the far field is about 1 Tesla.

The oil particles or hydrocarbons aggregate when the electromagnetic signal is applied and take a different form such that the particles become more slippery. The aggregation changes the viscosity of the particles and increases their mobility.

Figure 4:
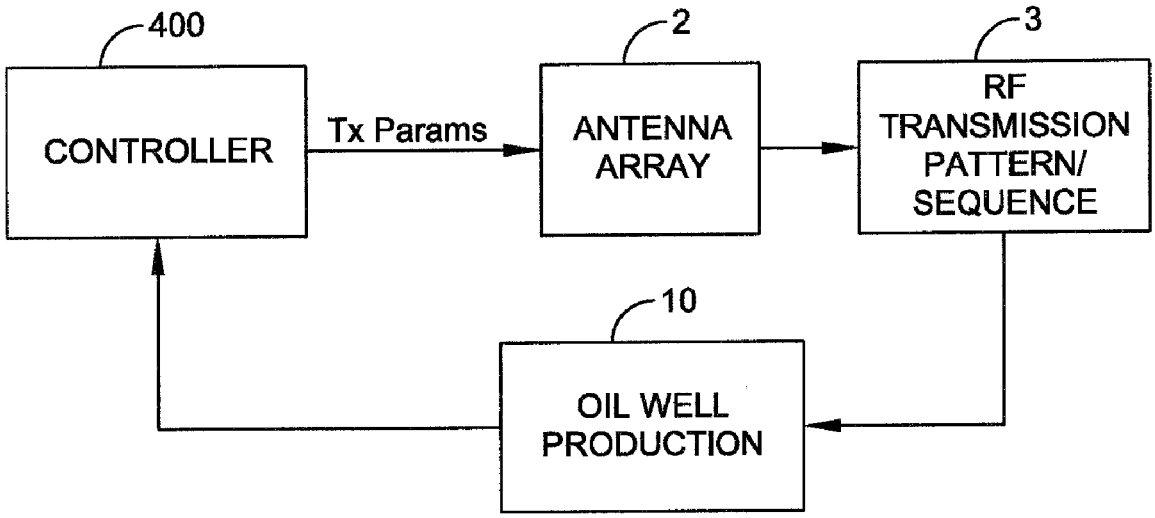
FIG. 4 is an exemplary block diagram illustrating control of the EM transmission and oil recovery system of the present invention.

It is further understood with reference to the illustration of FIG. 1 that the antennae may be controlled by means of an arrangement as shown in exemplary fashion by the block diagram of FIG. 4. A controller 400 operates to control the antenna 2 array parameters, including but not limited to frequency, duration, power output, pointing direction, and the like, so as to focus the energy signals 3 at the appropriate depth and level for causing the viscosity of the oil to decrease. A sensor arrangement and/or feedback mechanism may be employed, for example, based on monitoring the oil output from the production well 10, to enable the controller to modify the array parameters according to the well output.

For example, one or more sensors (e.g. fluid sensor) associated with the well bore 22 may be configured to determine and monitor the flow rate of oil recovered from the well bore. A signal from the sensor indicative of the oil flow rate may be communicated to the controller. If the flow rate is less than a predetermined value, the controller may adjust one or more transmit parameters to affect a change in the electromagnetic energy irradiated into the targeted subsurface region for enhancing oil flow. Such adjustments may be performed according to a programmed sequence of parameter adjustments, including but not limited to changes in frequency, directivity, gain, power levels, and target depth, by way of example only. In one configuration, if after a predetermined interval, oil output is not increased (or if the rate of change of oil output drops below a predetermined threshold, for example) the controller 400 may send a signal to modify one or more array parameters to cause a change in the EM signal transmitted to the reservoir. Such change may be monitored and further adjustments made to the EM transmission sequence according to the oil output from the well over a predetermined time interval. In this manner, oil located within the reservoir that would otherwise be too viscous to be harvested, may be irradiated by a magnetic field of sufficient strength, frequency, and duration so as to decrease the viscosity of the crude oil particles and thereby enhance migration of the oil particles to the central area A for extraction by the production well.

Figure 5A:
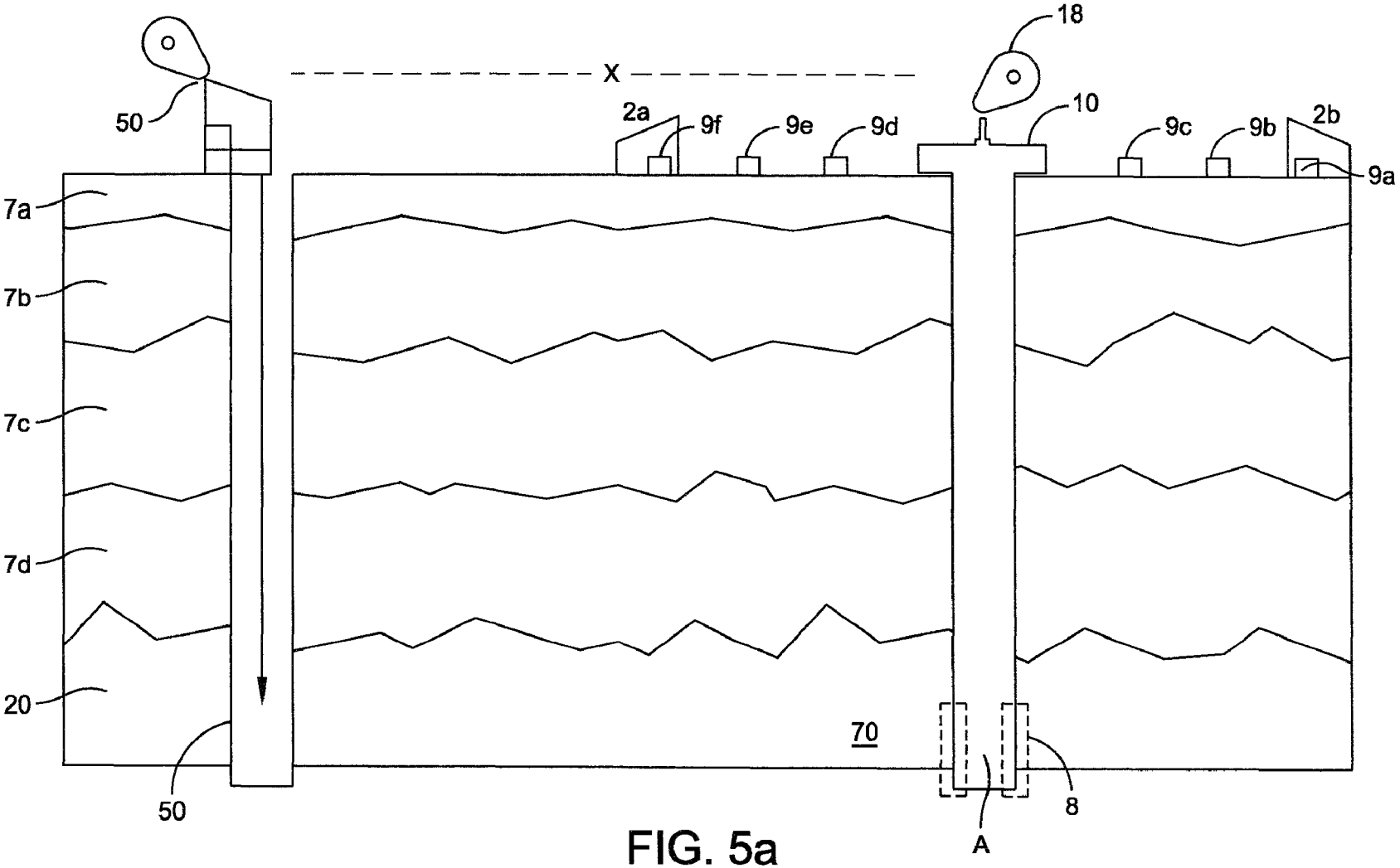
FIG. 5*a* is a schematic illustration of an oil field analogous to that shown in the system of FIG. 1 but further illustrating an auxiliary well typically for imparting secondary energy into the reservoir to enhance oil movement.

FIG. 5*a* shows an exemplary schematic illustration of an oil field analogous to that of FIG. 1 but further containing an auxiliary well 50 or applicator well positioned a predetermined distance x (e.g. 300 feet but may be up to about one thousand feet apart) from production well 10. Like reference numerals are used to indicate like parts. The auxiliary well provides a means for injecting gas or steam into the reservoir for facilitating oil movement toward the central area A. One or more such wells may be placed at locations within the reservoir to facilitate the oil displacement, as is well known in the art. The applicator wells are adapted so as to emit steam or water from the end of the casing (rather than receive fluid from the reservoir) from a source at the surface, thereby displacing the oil in the reservoir toward the central area. In an exemplary embodiment, a nanoparticle-fluid mixture may be injected via the applicator well into the reservoir to facilitate mixing with the crude oil to be harvested. In one configuration the nanoparticles may comprises nano-surfactant particles. The array of antennae may be configured so as to impart EM energy into the mixture. The EM energy field applied may be at a frequency corresponding to the nanoparticle absorption frequency so as to cause the nanoparticles to absorb and re-radiate energy to the oil particles and thereby increase the oil flow within the reservoir. The EM energy field may also be applied so as to heat up the nanoparticles and generate enhanced movement of the oil particles via thermal means. The antenna transmit parameters for exciting the catalyst nanoparticles may be different from those associated with transmission of electromagnetic energy sufficient to cause movement of the crude oil resulting from aggregation of the oil molecules, as described above.

Thus, there is disclosed a method for enhancing flow of crude oil particles within a select subsurface region separated from a terrain surface via geological strata. With respect to FIGS. 1-5*a*, the method includes positioning a plurality of transmit antennae 2 on or below the terrain surface 13 in a given pattern relative to the select subsurface region targeted for impingement, and controllably transmitting from the transmit antennae far field continuous wave (CW) or pulsed electromagnetic energy beams 21 of given frequency, power, directivity and duration through the geological strata to generate an aggregate magnetic field 15 having an isotropic profile 5 focused onto the select subsurface region containing the crude oil, wherein the aggregate magnetic field impinges upon the crude oil particles at a target frequency and energy sufficient to decrease the viscosity of the oil particles a given amount to enhance crude oil flow within the select subsurface region. The power and duration of the transmission are controlled so as to decrease the oil viscosity without increasing the temperature of the crude oil. Catalyst particles may be inserted into the select subsurface region containing the crude oil. The catalyst particles may be adapted to interact with the crude oil particles upon excitation and the aggregate magnetic field adapted by adjusting transmit parameters of the antennae to cause excitation of the catalyst particles to thereby impart energy to the crude oil particles to decrease the crude oil particle viscosity. In one embodiment, the catalyst particles are nanoparticles composed of nano-surfactant particles that could function to enhance the reception of electromagnetic energy.

In another configuration, there is provided a system for enhancing crude oil flow within a select subsurface region separated from a terrain surface via geological strata. The system comprises an array of transmit antennae positioned on or below the terrain surface and configured with respect to one another to transmit in the far field only continuous wave (CW) or pulsed electromagnetic energy beams through the geological strata to generate an aggregate magnetic field with isotropic profile focused onto the select subsurface region containing the crude oil. The aggregate magnetic field impinging upon crude oil particles is adapted to be at a frequency and energy level sufficient to cause a decrease in the viscosity of oil particles to enhance crude oil flow within the select subsurface region without increasing the temperature of the crude oil A controller coupled to the transmit antennae provides control parameters for configuring the transmit antennae to transmit the far field electromagnetic beams. The control parameters include one or more of predetermined frequency, power, directivity and transmit duration parameters.

In a preferred embodiment, each transmit antenna of the array of antennae transmits an electromagnetic energy beam having a conical profile. The antennae frequencies range from 100 Hz to 10 kHz. The select subsurface region is separated from the terrain surface by at least five hundred feet (500 ft). The target frequency of the aggregate magnetic field corresponds to a mechanical frequency associated with the oil particles to cause aggregation of the oil particles In a preferred embodiment, each transmit antenna comprises a compact parametric antenna having a dielectric, magnetically-active, open circuit mass core, with ampere windings around the mass core. The mass core is made of magnetically active material (e.g. liquid, powder or gel) that In the aggregate may have a capacitive electric permittivity from about 2 to about 80, an initial permeability from about 5 to about 10,000 and particle sizes from about 2 to about 100 micrometers. An EM source drives the windings to produce an electromagnetic wavefront. Each antenna is configured in a housing having a length of about 3 feet from the terrain surface. The antennae are preferably arranged in a uniform pattern about the well bore on or below the terrain surface. The well bore is in fluid communication with the select region for recovering the crude oil.

In a preferred embodiment, the system further comprises one or more sensors for determining a rate of oil flow recovered from the well bore. The controller is responsive to the determined flow rate from the sensing system for adjusting transmit parameters of the antennae when the flow rate reaches a given threshold.

Detection, Tracking and Imaging

According to another aspect of the present invention, the electromagnetic far field transmit antenna system described hereinabove may be utilized along with an arrangement of electromagnetic receiver antennae and operated to measure and track the movement of fluid (e.g. oil and/or water and/or gas) within the reservoir. This may be accomplished, for example, by first adapting the CPA transmitters discussed hereinabove to operate in a pulsed operational mode. For detection and tracking, the CPA transmitters are configured to generate electromagnetic energy pulses of a given duty cycle, frequency, directivity, and the like, rather than operate in CW mode. It is further understood that the CPA transmit parameter values associated with the transmit array configuration (as described with regard to FIGS. 1-4) for transmission sequences designed to detect, track movement, and/or image a fluid (e.g. oil and/or water) or map a subterranean permeable formation are not the same as those transmit parameter values used to enhance oil flow by means of aggregation and decreased viscosity of the oil as discussed above. Moreover, for detection, tracking and imaging, the transmitter and receiver functionality is coordinated and employed in a pulsed sequence mode as discussed herein.

Figure 5B:
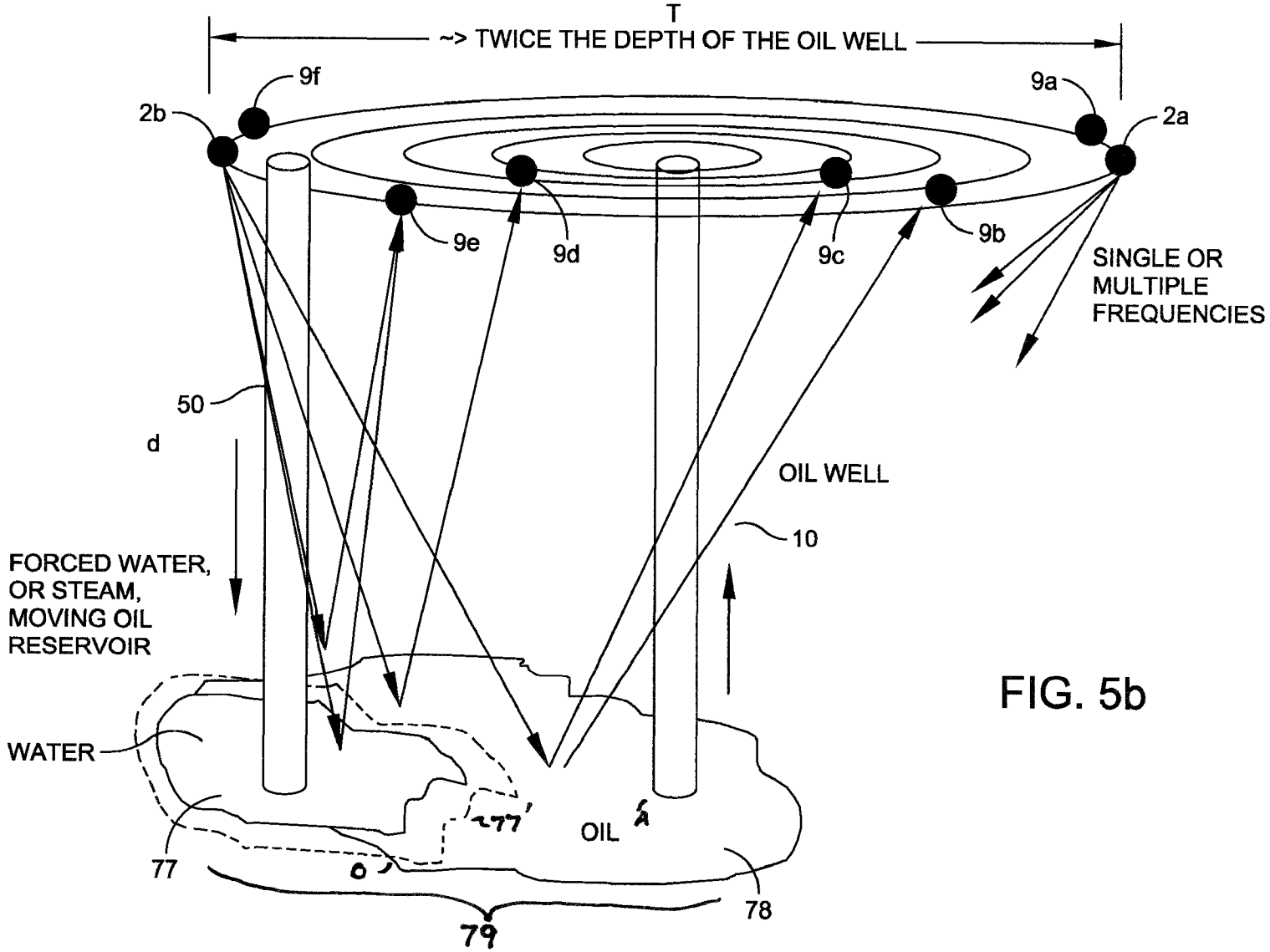
FIG. 5*b* is a schematic illustration of a plurality of CPA antenna receivers positioned about the surface of the earth and adapted for receiving EM signal reflections from the reservoir according to EM transmission sources and useful for mapping features of the reservoir in the system of FIG. 5*a* or FIG. 1.

Referring to FIGS. 5*a* and 5*b*, in addition to the CPA transmit antennae, the system further includes an array of antenna receivers (e.g. CPA receivers). The CPA receiver antennae are analogous to the CPA transmitter antennae described above for transmitting electromagnetic pulsed energy signals into the reservoir at the surface in a pattern about or over the reservoir. The CPA receiver antennae operate to receive and process reflections of the electromagnetic transmissions from the transmit antennae. A processor such as a digital signal processor receives the reflected signals from the receivers and correlates the reflections over a given time interval. The results of the correlation provide an output indicative as to whether the oil and/or water has moved or migrated within the reservoir. The signal processor may be configured within the controller or as a standalone unit operatively coupled to the controller and/or receiver circuitry and includes a memory for storage/retrieval of associated data, including but not limited to reflection intensity scan data, characteristics (e.g. loss, absorption characteristics as a function of frequency, etc.) associated with permeable formations, and the like. In a preferred embodiment, the transmitters and receivers are CPA antenna transmitters and receivers, respectively.

Referring to FIG. 5*a* in conjunction with FIG. 5*b*, a system including a transmitter antenna array 2 and a receiver antenna array 9 is depicted to illustrate the fluid detection and tracking technique according to an embodiment of the present invention. As shown schematically in FIG. 5*b*, in one embodiment, the system is adapted to transmit immediately in the far field electromagnetic focused to a given depth of the reservoir for covering a target area 79 of the reservoir containing various media including oil, water, rock formations, and the like. Receiver antennae 9 positioned at predetermined locations about the terrain surface (or below it) are adapted to receive reflections from the transmitted electromagnetic signals for tracking the relative movement of fluid media within the reservoir. In one configuration shown in FIG. 5*b*, a forced fluid (e.g. water) from applicator well 50 is input into the target area to cause migration of oil particles from outer portions of the reservoir (e.g. label O) to the more central area (e.g. label A) near the casing for extraction by the production well 10.

By way of non-limiting example only, a plurality of CPA receivers (e.g. 9*a*, 9*b*, 9*c*, 9*d*, 9*e*, 9*f*) are positioned about the terrain surface proximal to well 10 and adapted for receiving electromagnetic signal reflections from the reservoir at depth d (of at least 500 feet) as seen in FIG. 5*b*. A plurality of CPA transmitters (e.g. 2*a*, 2*b*) are also positioned about the terrain surface of the oil production well 10. The well bore casing(s) (see e.g. FIG. 1, FIG. 5*a*) may be made of an electromagnetic transmissive material so as to not interfere with the pulsed signal transmissions and reflections. The overall horizontal distance T about which the transmitter/receiver array elements are positioned is about twice the depth d. The transmitters and receivers are positioned preferably at an angle of about 45 degrees and typically several hundred meters from the oil well with the transmitters 2 operative to perform a sequence of electromagnetic transmissions over a range of frequencies (e.g. a series of stepped electromagnetic frequencies) and at appropriate power levels.

The tracking system operates by transmitting immediately in the far field electromagnetic pulsed energy signals at relatively low carrier frequencies (in the range of about 1 Hz to tens of Hz) with modulations ranging from 1-20 Hz. A controller 400 (see FIG. 6*a*) operates to change the modulation frequencies and/or the receiver frequencies for the reflected signals received by the receiver antennae which are processed using a digital signal processor and memory (included for example, in controller 400) to provide an output indicative of the relative movement of oil and/or water within the reservoir. The reflected signals are received at the array of receivers 9 and relative measurements of the intensities of the reflected signals are obtained and processed to determine a background or threshold signal mapping of the reservoir.

With further reference to FIG. 5*a* in conjunction with FIG. 5*b* when water is applied to the reservoir via the applicator well 50, the applied water begins to migrate over larger and larger portions of the reservoir, as shown by the expanded fluid footprint 77' depicted in FIG. 5*b*. By iteratively performing the transmit/receive sequencing described above and monitoring the reflective output, a relative change in the mapping parameters or characteristics over time may be seen due to differences in the level of electromagnetic absorption in water relative to that of oil or the reservoir material itself (e.g. rock, sand, and the like at a given location or area). In this manner, the relative differences in the reflected signals provide an indication as to the path that the water is taking and/or the level of encroachment of the water applied via well 50 to the reservoir. Such monitoring of received energy signals and determination of relative changes over time and tracking of such relative changes may be accomplished using conventional signal processing techniques and image mappings and will not be discussed further in detail for the sake of brevity.

In one embodiment, the transmit antennae is configured to transmit in a predetermined pattern or sequence over several different frequencies and/or power levels with the receiver antennae adapted to receive the reflections according to the particular frequency transmitted. The selection of frequencies, orientations and/or power levels are in accordance with the material properties detected or estimated to be contained within the reservoir (e.g. water, oil, rock, sand) to obtain a common mode error. The results may be stored in memory for further processing.

Estimates may be made as to the expected losses through the strata at different frequencies (for example, estimated losses at 1 KHz, 10 KHz, etc.) with the changes occurring as background changes to a composite mapping of the reservoir. Multiple receiver antennae may be adapted in a given pattern (e.g. a circular pattern) so as to initially image the reservoir area to obtain a baseline image of the reservoir. By way of example only, Based on a depth of 1000 feet and a circular footprint of 1000 feet diameter, the cone volume would be for the transmit/receive is estimated at about 25 million cubic meters and the target area about 75,000 square meters.

In one exemplary embodiment, water is applied to the reservoir and the transmitters operated. The receiver array (and signal processing) detects the relative changes to the reservoir mapping so as to enable real time monitoring of the encroaching water. Such mapping and monitoring advantageously allows an operator to determine if the water application is proceeding as expected, or if alternative measures need to be taken.

For example, a fissure or other material formation within the reservoir may often divert water applied from the auxiliary well from its desired path, such that the applied water does not force the oil toward the central area as expected. This diverting may cause the well to become very inefficient, particularly if the diverting remains undetected. According to an embodiment of the invention, this problem is mitigated by applying appropriate electromagnetic energy signals and determining electromagnetic responses so as to map the migration of water in real time, enabling the detection and determination as to whether the applied water is "on track" or whether additional actions or remedial measures need to be taken. It is to be understood that the terrain mapping technique described above may be implemented by determining an image plane in both depth and width and using multiple frequency transmissions and responses/detections to provide an entire volumetric mapping of the reservoir volume. Furthermore, the mapping data for the reservoir volume may be stored in memory within the controller (or remotely) to form a signature data base or library of the imaged site may be that would be used as a comparative calibration for determining reservoir movement. This may be accomplished for each of the various layers or depths (see e.g. layers 7*a*-7*d*) including the reservoir region 70 as seen in FIG. 5*a*. This site reference signature would represent a three dimensional footprint at each monitoring period and form the basis of a four dimensional footprint as a function of time.

Figure 6A:
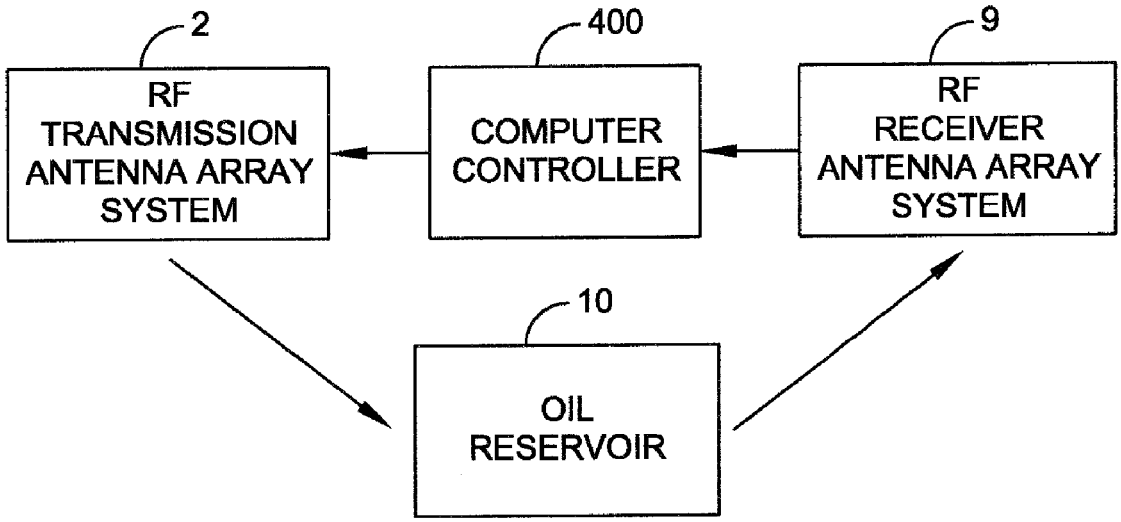
FIGS. 6*a*-6*c* are block diagrams showing exemplary processing sequences for determining geological mapping in accordance with embodiments of the present invention.

A block diagram showing an exemplary processing sequence for determining water and/or oil flow is shown in FIG. 6*a*. As generally illustrated, immediate far field electromagnetic pulses transmitted from array system 2 (positioned at the surface or within a well area such as an auxiliary well) are incident onto the permeable formation layer 10 containing the water and/or oil. Calibration techniques may be implemented such that one or two antennae would transmit from a separated position (e.g. about twice the depth) in the well. Receivers 9 positioned between the transmitters monitor the intensity of the reflected returns. In an exemplary embodiment, fluid (e.g. water) seeping or flushed into the reservoir causes movement of oil within the reservoir. The reflected return signals received by the antenna array will change, for example, based on the different absorption characteristics of water relative to oil or rock within in the reservoir, such that at least a relative horizontal migration of fluid can be detected and tracked by the system. A controller 400 comprising a processor such as a digital signal processor, memory and corresponding control circuitry is operably coupled to the transmitter/receiver antennae arrays so as to monitor the receiver output and adjust the transmitter input as needed to track the detected movement of fluid within the reservoir.

In a preferred embodiment, monitoring oil and/or water or gas movement may be accomplished by measuring the reflected intensity of the CPA antennae where the incident transmission angle is $>10^0$. The CPA frequency can be in the range from about 100 hertz (Hz) to more than 50 kilo-hertz (kHz). Reciprocal CPA units can be used to mitigate common mode error. Multiple transmitter frequencies can be used to measure and compute path loss. A display device operably coupled to the controller may be used to provide real time data to an operator indicating the relative movement of the water and/or oil within the reservoir.

Figure 6B:
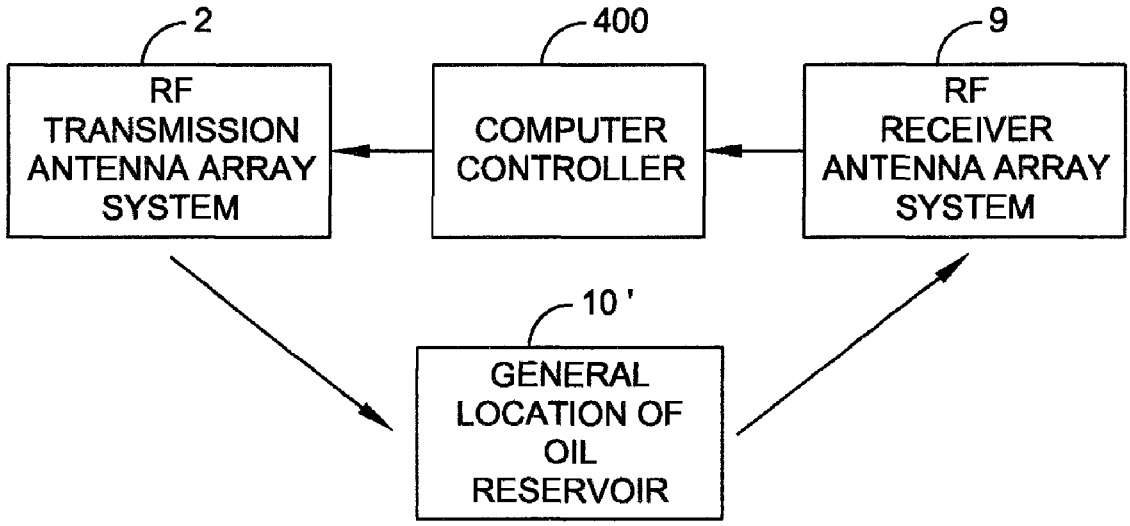
Figure 7:
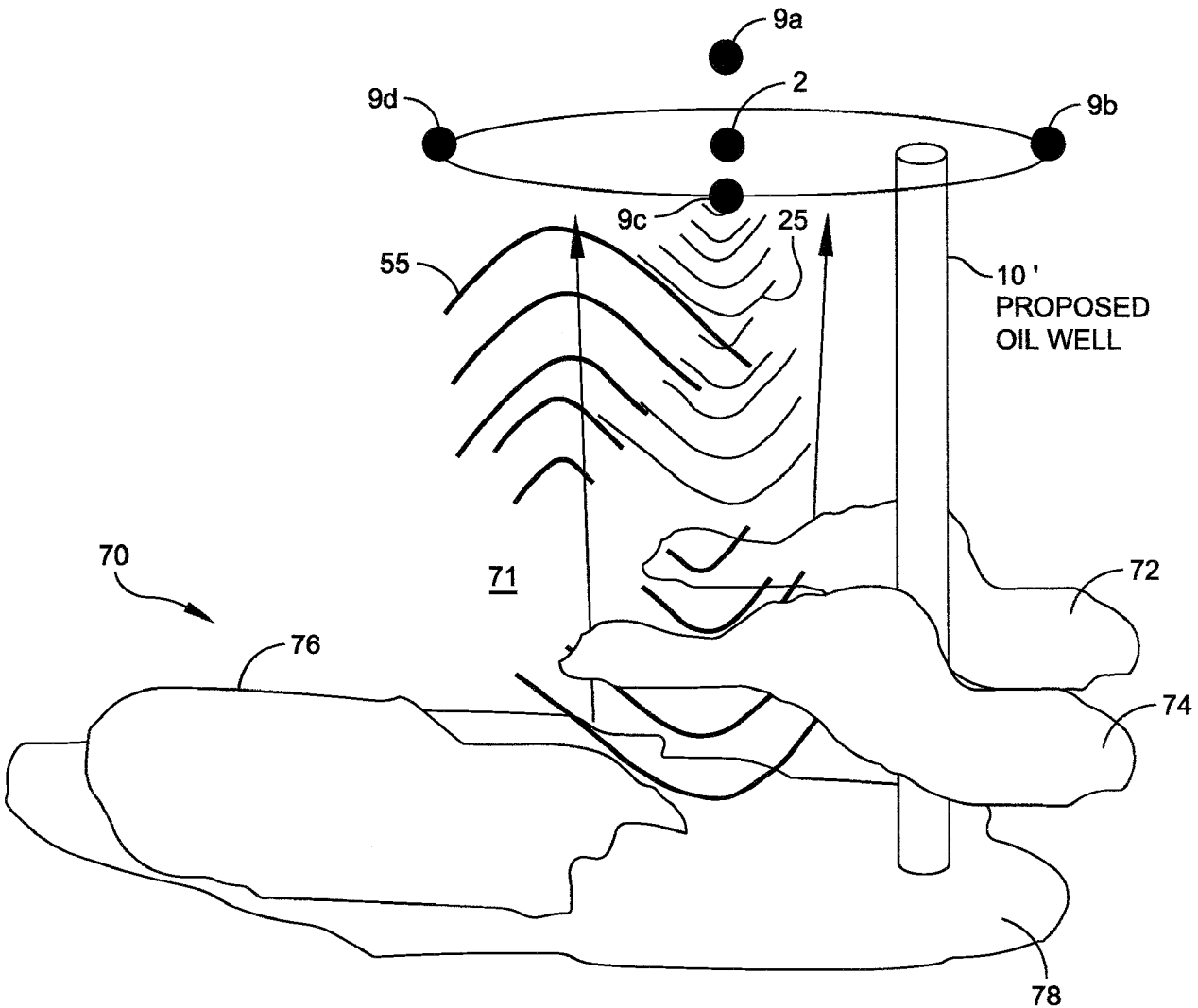
FIG. 7 is a schematic illustration of a drill site containing various geological formations to be mapped for determining an optimal well location for drilling a well according to an aspect of the present invention.

According to aspects of the present invention, the electromagnetic transmitter/receiver array as discussed above with respect to FIG. 5*a* and FIG. 5*b* may be applied to aid in determining an optimal location of a production well or the location of an auxiliary well relative to the production well. For example, with reference to FIG. 6*b* and FIG. 7, the array of transmitters (2)/receivers (9) described with regard to FIG. 5*b* may be modified in frequency, power level, duration, stepping functions and the like so as to obtain a geological static picture or image of the permeable formation of an area shown as reservoir 70. The reservoir 70 may contain various geological formations, including oil deposits 78, rock formations 72, 74, and gravel formation 76, at various depths between the sand layer 71. The sequence of transmissions 25 from the transmit antennae 2 and reflections 55 received by the receiver antennae 9 are stepped so as to scan in depth and frequency the volume corresponding to the target region selected for coverage. The reflections are processed and correlated to provide a mapping of the various media within the target region. This allows one to determine how, for example, the oil 78 is dispersed within a sub region of the reservoir, thereby enabling determination of an optimal location and placement of a production well 10'.

As described above, controller 400 controls the processing and sequencing of transmit receive data so as to obtain three dimensional imaging of the oil within the sub region by using different frequencies to determine the "pockets" of oil (and the relative size of the pockets). Based on the return signal distance, the intensity and frequency response of the returned signal, determination may be made as to the material content (e.g. rock, sand, gravel, water or oil), the magnitude or size of the material, and the relative shape or structure of the material. Frequency hopping and/or other signal processing techniques may be used to obtain a mapping of the geology that the oil is in.

In one configuration, the system operates to transmit far field electromagnetic pulses, immediately from the transmit antennae, directly into the earth so that the receiver antennae measure reflected return signals in order to map out optimal locations to drill well(s). The receiver antennae can be on the ground or beneath the ground. Using appropriate electromagnetic frequencies (e.g. ranging from 100 Hz to about 50 KHZ) and power levels of 10 Kw or greater, the strength of the reflected returns provide an indication as to the sub-surface ground composition. For example, using appropriate electromagnetic frequencies and power levels, the strength of the reflected returns will indicate sub-surface fracture corridors. Using multiple frequencies from the same antenna, the ground composition can be inferred by the effective reflective losses. Time gating the reflected responses to correlate with the transmitted pulse sequences allows for a determination as to the material content of the reservoir, including for example, the location of oil deposits relative to fissures or other strata, thereby providing real time information regarding precise location(s) at which to establish and drill the production and/or auxiliary wells.

Figure 6C:
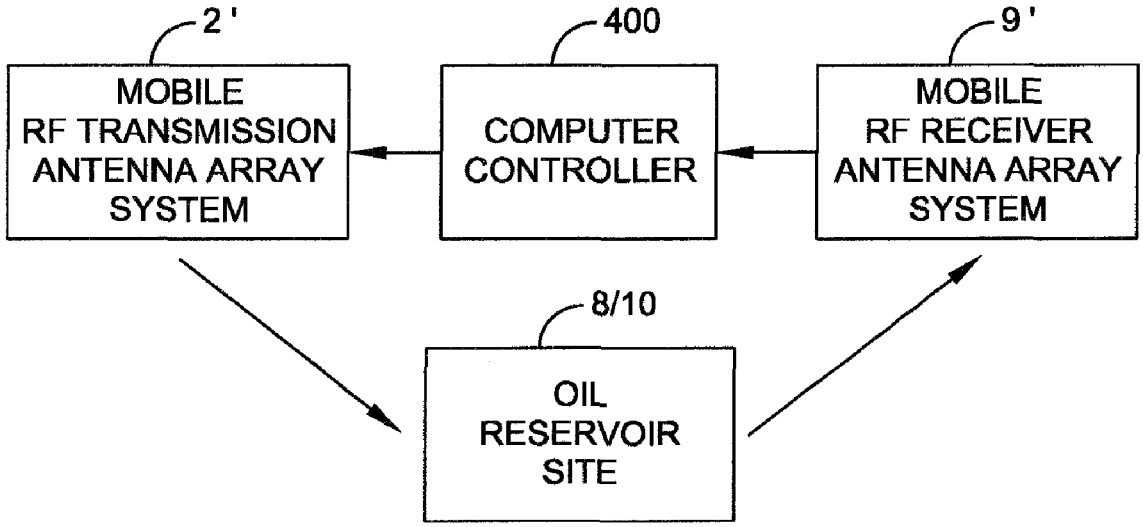
Figure 8:
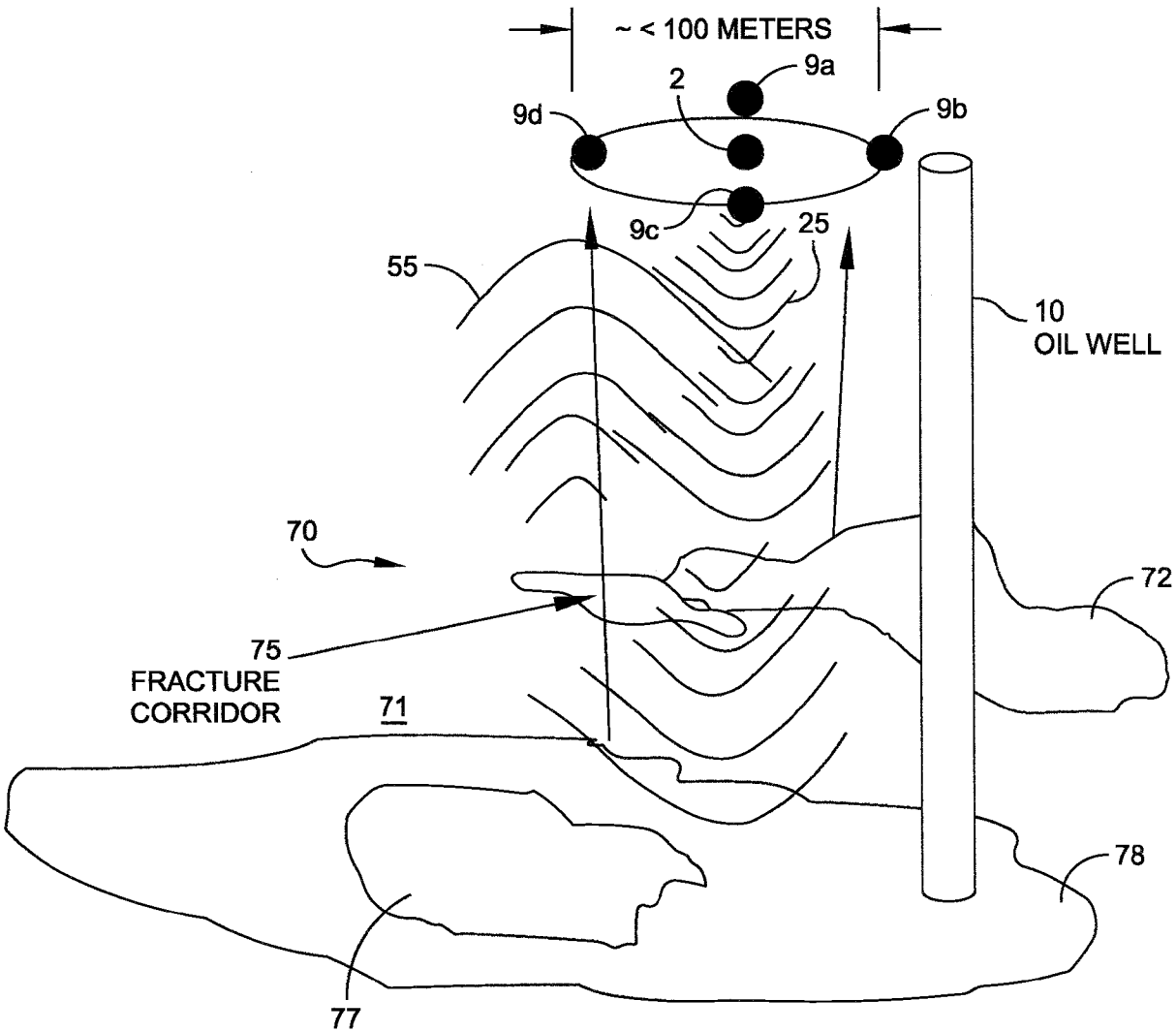
FIG. 8 is a schematic illustration of a drill site containing various geological formations to be mapped for determining how to optimize oil recovery given the existing well location according to an aspect of the present invention.

FIG. 8 is an exemplary illustration showing the transmission/reception of electromagnetic energy pulses from the array 2, 9 so as to aid in determining the geological features about an oil deposit 78 for an existing oil well 10. By tuning the transmitter/receiver antennae to detect particular features such as fracture corridors 75 or rock interfaces 72, the transmitters/receivers provides information that permits one to determine the most efficient and/or effective method of extracting oil from the reservoir (e.g. placement of additional auxiliary wells, positioning of CPA transmitters for pulsing select areas of the reservoir to increase mobility of the oil in select locations, and the like). It is of course understood that depending on the particular application, different frequencies and/or Tx/Rx power levels and durations may be used. For example, frequencies used to determine the content of the permeable formation (e.g. determining rock, clay, sand or gravel) will be different than those for imaging oil (or water). The computer controller unit 400 comprising a digital signal processor and antenna controller may be used to process the signals and frequencies according to the particular application. Such processing may be accomplished in accordance with the block diagram of FIG. 6*c*. Two dimensional (2D) mapping and imaging of the subsurface can be accomplished by rotating the sensor transmit/receiver assembly at various radii of on the order of hundreds of meters, for example. Lookup tables of reflection/absorption values may be used to assist in the determination and estimation of the content and range of the geological features under test.

While the present invention has been described with reference to the disclosed embodiments, it will be appreciated that the scope of the invention is not limited to the disclosed embodiments, and that numerous variations are possible within the scope of the invention.

What is claimed is:

1. A method for determining subsurface geological features at an existing oil well site having a well bore disposed through strata to a given subsurface layer depth for recovering crude oil in a fluid reservoir at said subsurface depth but horizontally remote from said well bore, the method comprising:

a) from multiple positions on the terrain surface, transmitting immediately in the far field a sequence of pulsed electromagnetic energy beam signals focused at a target depth, wherein the signals combine to cover a target area of a formation layer that lies between the terrain surface and said given subsurface layer containing the fluid reservoir defining a scan, the target area having a center offset horizontally from the well bore;

b) receiving reflections from the target area in response to the sequence of transmitted pulsed energy beam signals impinging thereon, the reflections being characteristic of particular media located within the target area being impinged upon by the immediately transmitted far field pulsed electromagnetic energy beam signals;

c) correlating the received reflections from said target area over a given time interval for a given scan to determine relative changes in intensities of reflections over said target area for a given scan;

d) storing the scan data for each scan in memory;

modifying transmit parameters in at least one of frequency, focus depth, and phase shift and repeating steps a)-d) to generate volume data for each layer up to said given subsurface layer;

identifying particular media and their location within the volume according to the scan data, wherein the identifying includes identifying the location of crude oil relative to other of the particular media.

2. The method of claim 1, further comprising drilling an auxiliary well for insertion of a forced fluid into the auxiliary well.

3. The method of claim 1, wherein the path of the borehole is adapted to avoid select ones of said particular media within the reservoir and encounter said crude oil media based on said identification.

4. The method of claim 1, wherein the identifying comprises correlating the relative changes in intensities of reflections with data relating to characteristics of particular media stored in memory to identify select ones of the particular media within the volume.

5. The method of claim 1, wherein said particular media include at least one of rock and water.

6. The method of claim 5, wherein said crude oil particles have reflection characteristics different from that of rock and water.

7. A system for determining subsurface geological features at an existing oil well site having a well bore disposed through strata to a given subsurface layer depth for recovering crude oil in a fluid reservoir at said subsurface depth but horizontally remote from said well bore, the method comprising:

a) a plurality of transmit antennae located at multiple positions on the terrain surface, the antennae transmitting immediately in the far field a sequence of pulsed electromagnetic energy beam signals focused at a target depth, wherein the beams combine to cover a target area of a formation layer that lies between the terrain surface and said given subsurface layer containing the fluid reservoir defining a scan, the target area having a center offset horizontally from the well bore;

b) a plurality of receive antennae located at multiple positions on or below the terrain surface, the receive antennae receiving reflections from the target area in response to the sequence of transmitted pulsed energy beam signals impinging thereon, the reflections being characteristic of particular media located within the target area being impinged upon by the immediately transmitted far field pulsed electromagnetic energy beam signals;

c) a processor adapted to correlate the received reflections from said target area over a given time interval for a given scan to determine relative changes in intensities of reflections over said target area for a given scan;

d) memory for storing the scan data for each scan;

e) a controller for modifying transmit parameters in at least one of frequency, focus depth, and phase shift for each of a plurality of selected target depths to thereby define a scanned volume for each layer up to said given subsurface layer;

wherein the processor identifies particular media and their location within the volume according to the scan data, including identifying the location of crude oil relative to others of the particular media.

8. The system of claim 7, wherein the processor is adapted to correlate the relative changes in intensities of reflections with data relating to characteristics of particular media stored in memory to identify select ones of the particular media within a given formation layer.

9. The system of claim 7, wherein said particular media include at least one of rock and water, and wherein said crude oil has reflection characteristics different from that of rock and water.

10. The system of claim 7, wherein an initial reflectance reference is established indicative of the intensities of reflected signals from the target volume over a predetermined interval, and wherein said signal processor compares subsequent reflective intensities received in response to pulsed electromagnetic transmissions to said initial reflectance reference to determine relative movement of the particular media within the volume.

11. The system of claim 7, wherein each of said transmit antennae comprises a compact parametric antenna having a dielectric, magnetically-active, open circuit mass core, ampere windings around said mass core, said mass core being made of magnetically active material having a capacitive electric permittivity from about 2 to about 80, an initial permeability from about 5 to about 10,000 and a particle size from about 2 to about 100 micrometers; and an electromagnetic source for driving said windings to produce an electromagnetic wavefront.

* * * * *

UNITED STATES PATENT AND TRADEMARK OFFICE

CERTIFICATE OF CORRECTION

PATENT NO. : 8,242,781 B2
APPLICATION NO. : 12/545068
DATED : August 14, 2012
INVENTOR(S) : Vincent Benischek et al.

It is certified that error appears in the above-identified patent and that said Letters Patent is hereby corrected as shown below:

Claim 7 on column 16, line 2, the second to last word should be "system".

Signed and Sealed this
Twenty-ninth Day of January, 2013

David J. Kappos

David J. Kappos
*Director of the United States Patent and Trademark Office*